US009368094B1

(12) United States Patent
Rognlien et al.

(10) Patent No.: US 9,368,094 B1
(45) Date of Patent: Jun. 14, 2016

(54) STRINGED INSTRUMENT NECK SUPPORT

(71) Applicant: Music Nomad LLC, Sonoma, CA (US)

(72) Inventors: Rand Rognlien, Sonoma, CA (US); Pieter Hans Schouten, Berkeley, CA (US)

(73) Assignee: Music Nomad LLC, Sonoma, CA (US)

( * ) Notice: Subject to any disclaimer, the term of this patent is extended or adjusted under 35 U.S.C. 154(b) by 0 days.

(21) Appl. No.: 15/040,356

(22) Filed: Feb. 10, 2016

Related U.S. Application Data

(60) Provisional application No. 62/114,170, filed on Feb. 10, 2015.

(51) Int. Cl.
*G10G 5/00* (2006.01)

(52) U.S. Cl.
CPC ..... *G10G 5/00* (2013.01)

(58) Field of Classification Search
CPC ..... G10G 5/005; G10G 5/00; G10G 7/00; G10G 7/005; G10G 1/02; G10G 1/04; G10D 13/026; G10D 3/06; Y10T 29/49826; Y10T 428/24479; F16M 13/00; B27H 1/00
USPC ..... 84/327, 329, 290, 453
See application file for complete search history.

(56) References Cited

U.S. PATENT DOCUMENTS 5,616,874 A * 4/1997 Kraus ..... G10G 5/005 84/327
7,744,047 B2 * 6/2010 Thorn ..... G10G 5/00 248/176.3
2015/0340020 A1 * 11/2015 Noska ..... G10G 5/00 84/327

* cited by examiner

*Primary Examiner* — Kimberly Lockett
(74) *Attorney, Agent, or Firm* — Patent Law Offices Michael E. Woods; Michael E. Woods

(57) ABSTRACT

A system and method for safely supporting a stringed musical instrument at various positions of orientation while processing actions are being performed on the instrument. A support structure includes a plurality of reorientable surfaces that each present a depression, a majority of the depressions each having a slope relative to a longitudinal axis (all slopes may be different) to provide an adjustable work surface, such a supporting a musical instrument in various configurations and arrangements.

26 Claims, 11 Drawing Sheets

STRINGED INSTRUMENT NECK SUPPORT

CROSS REFERENCE TO RELATED APPLICATIONS

This application claims benefit of U.S. Patent Application No. 62/114,170 filed 10 Feb. 2015, the content of which is hereby expressly incorporated by reference thereto in its entirety for all purposes.

FIELD OF THE INVENTION

The present invention relates generally to a support for a musical instrument, and more specifically, but not exclusively, to a device which supports stringed musical instrument during various procedures such as, for example, re-stringing, adjustment, repair, or assembly.

BACKGROUND OF THE INVENTION

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

During their repair, ongoing maintenance (including, for example, re-stringing), or assembly (herein, collectively, processing), stringed musical instruments are subjected to various forces. Because of their inherent fragility, stringed musical instruments are susceptible to physical damage during processing. When excessive stresses are applied to their structure during processing, irreparable damage may result. The probability of such an adverse outcome is increased when the musical instrument is not properly supported. For instance, when re-stringing, replacing frets, or planing fingerboards on the neck of a stringed instrument, proper support of the neck is essential in order to selectively restrict the natural flexibility of the neck along its length.

A further consideration with respect to processing of stringed musical instruments is the orientation of the instrument during such procedures. In order to execute a wide range of processing actions on stringed instruments, the instrument must often be manipulated into various positions to permit access to the particular elements of the instrument. Typically one or both of the neck and body must be supported during these various manipulations. For example, in some situations the instrument is directly supported at its neck to permit a person to perform work on the body. At other times, both the body of the instrument, as well as its neck, require some direct support on the horizontal or at an angle from the horizontal to permit ease of access to various components of the instrument.

The prior art includes devices for supporting musical instruments during these processes that include moveable elements and structures. These elements and structures permit the supporting device to be adjusted for a particular specific support. However this adjustability adds costs and complexity that can make the support device itself more difficult to use and maintain.

What is needed is a system and method for safely supporting a stringed musical instrument at various positions of orientation while processing actions are being performed on the instrument.

BRIEF SUMMARY OF THE INVENTION

Disclosed is a system and method for safely supporting a stringed musical instrument at various positions of orientation while processing actions are being performed on the instrument.

The following summary of the invention is provided to facilitate an understanding of some of technical features related to musical instrument support, and is not intended to be a full description of the present invention. A full appreciation of the various aspects of the invention can be gained by taking the entire specification, claims, drawings, and abstract as a whole. The present invention is applicable to other devices besides musical instruments.

An embodiment includes a generally cubic structure having five supporting surfaces, each supporting surface of the disclosed embodiment presenting a different support height and/or support angle for receipt of a neck of a stringed musical instrument. A sixth surface may include an opening into an internal cavity that may be used for storing tools. The structure requires no moving parts and may be made of a material that does not damage a finish of the musical instrument. Alternatively the structure may be made of multiple parts including an internal rigid frame providing the shape and outer conforming sleeve providing a protective soft interface to the neck of the instrument.

This 5-in-1 cradle cube neck support includes an innovative soft gel material to gently yet fully support either side of the neck (e.g., a front side where frets and strings may be present or a back side opposite of the). With 5 varying heights and angles, it works great for all necked string instruments—such as for example acoustic guitars, electric guitars, ukuleles, violins, banjos, mandolins and more. Safe on instrument finishes without a risk of scratches, nicks, mars or other finish damage. The cradle cube helps you change strings quicker and do repairs and maintenance in a secure and sturdy way.

A support structure, including a housing defining a first surface, a second surface spaced apart from the first surface, and a longitudinal axis and a plurality of intermediate surfaces extending from the first surface to the second surface; wherein a first particular one of the intermediate surfaces includes a first depression extending longitudinally from the first surface to the second surface, the first depression having a first slope, relative to the longitudinal axis, extending from the first surface to the second surface; wherein a second particular one of the intermediate surfaces includes a second depression extending longitudinally from the first surface to the second surface, the second depression having a second slope, relative to the longitudinal axis, extending from the first surface to the second surface; and wherein the first slope is different from the second slope.

A support structure, including a housing defining a first surface, a second surface spaced apart from the second surface, a longitudinal axis extending from the first surface to a second surface, a first intermediate surface extending longitudinally from the first surface to the second surface, a second intermediate surface extending longitudinally from the first surface to the second surface and disposed opposite of the first intermediate surface, a third intermediate surface extending longitudinally from the first surface to the second surface, and a fourth intermediate surface extending longitudinally from the first surface to the second surface and disposed opposite of the third intermediate surface, wherein each the intermediate surface includes a uniform cross-section depression extending longitudinally from the first surface to the second surface; wherein each the depression includes a slope, relative to the longitudinal axis, extending from the first surface to the second surface; wherein a first pair of intermediate surfaces include the first intermediate surface and the second uniform surface; wherein a second pair of intermediate surfaces include the third intermediate surface and the fourth uniform surface; wherein the depressions of the first pair of intermediate surfaces include a "U" shaped profile; wherein the depressions of the second pair of intermediate surfaces include a "V" shaped profile; wherein the first surface has a first width and a first length about equal to the first width and wherein the second surface has a second width and a second length about equal to the second width; wherein the second width is less than the first width, wherein the second surface is spaced apart from the first surface by a height, and wherein a width difference equals the first width minus the second width and wherein an inverse tangent function of one-half the width difference divided by the height is about 2.5 degrees; and wherein the slopes are different from each other and no greater than about 5 degrees.

Any of the embodiments described herein may be used alone or together with one another in any combination. Inventions encompassed within this specification may also include embodiments that are only partially mentioned or alluded to or are not mentioned or alluded to at all in this brief summary or in the abstract. Although various embodiments of the invention may have been motivated by various deficiencies with the prior art, which may be discussed or alluded to in one or more places in the specification, the embodiments of the invention do not necessarily address any of these deficiencies. In other words, different embodiments of the invention may address different deficiencies that may be discussed in the specification. Some embodiments may only partially address some deficiencies or just one deficiency that may be discussed in the specification, and some embodiments may not address any of these deficiencies.

Other features, benefits, and advantages of the present invention will be apparent upon a review of the present disclosure, including the specification, drawings, and claims.

BRIEF DESCRIPTION OF THE DRAWINGS

The accompanying figures, in which like reference numerals refer to identical or functionally-similar elements throughout the separate views and which are incorporated in and form a part of the specification, further illustrate the present invention and, together with the detailed description of the invention, serve to explain the principles of the present invention.

FIG. 8 illustrates a representative support cube above a planar support surface and further depicts a first set of slope values of depressions in a first set of opposing intermediate surfaces;

FIG. 9 illustrates the representative support cube of FIG. 8 disposed on the support surface;

FIG. 10 illustrates the representative support cube above the planar support surface in a different orientation further depicting a second set of slope values of depressions in a second set of opposing intermediate surfaces; and FIG. 11 illustrates the representative support cube of FIG. 9 with its particular orientation disposed on the support surface.

DETAILED DESCRIPTION OF THE INVENTION

Figure 1:
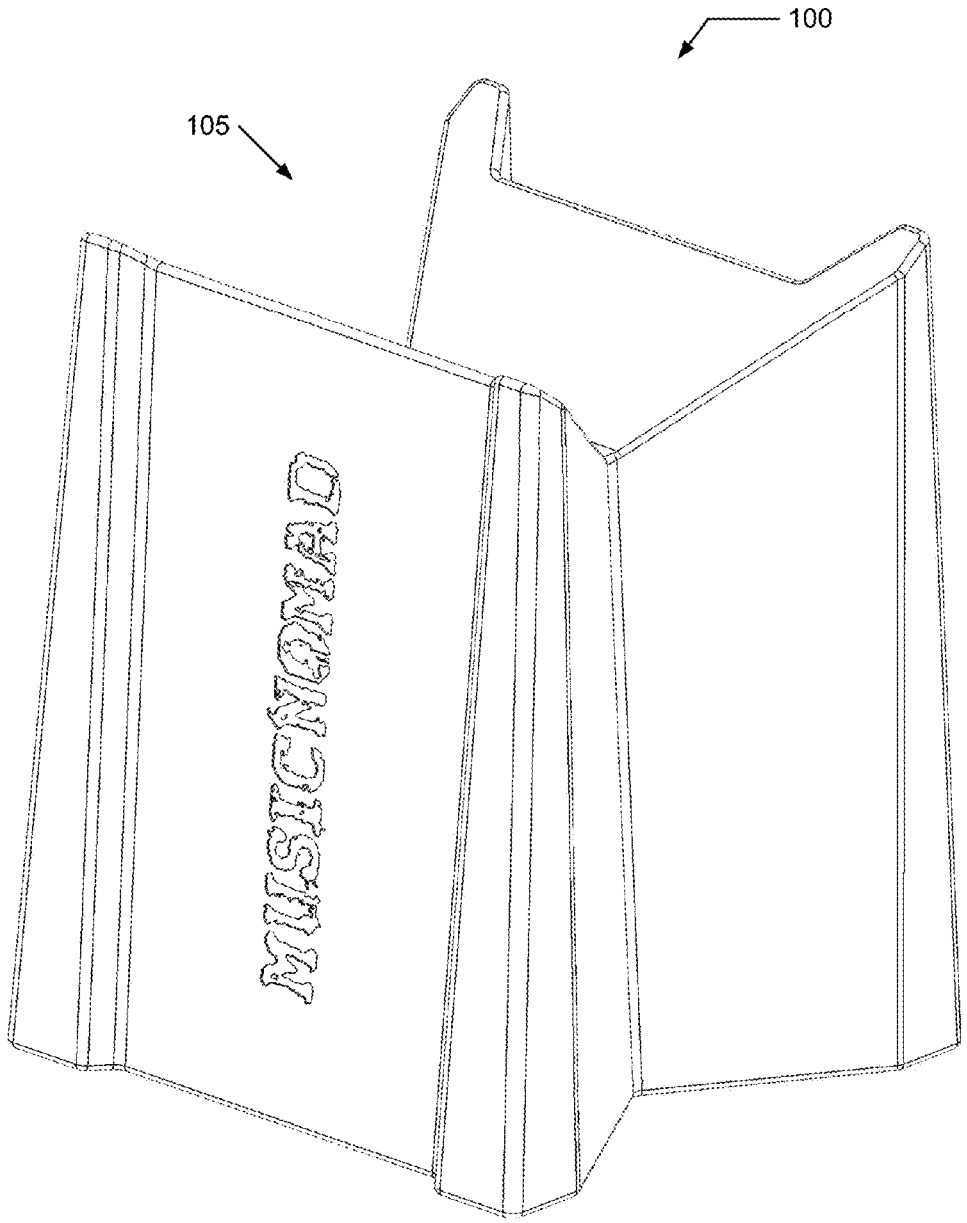
FIG. 1 illustrates a perspective view of a support cube.

Embodiments of the present invention provide a system and method for safely supporting a stringed musical instrument at various positions of orientation while processing actions are being performed on the instrument. The following description is presented to enable one of ordinary skill in the art to make and use the invention and is provided in the context of a patent application and its requirements.

Various modifications to the preferred embodiment and the generic principles and features described herein will be readily apparent to those skilled in the art. Thus, the present invention is not intended to be limited to the embodiment shown but is to be accorded the widest scope consistent with the principles and features described herein.

DEFINITIONS

Unless otherwise defined, all terms (including technical and scientific terms) used herein have the same meaning as commonly understood by one of ordinary skill in the art to which this general inventive concept belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

The following definitions apply to some of the aspects described with respect to some embodiments of the invention. These definitions may likewise be expanded upon herein.

As used herein, the term "or" includes "and/or" and the term "and/or" includes any and all combinations of one or more of the associated listed items. Expressions such as "at least one of," when preceding a list of elements, modify the entire list of elements and do not modify the individual elements of the list.

As used herein, the singular terms "a," "an," and "the" include plural referents unless the context clearly dictates otherwise. Thus, for example, reference to an object can include multiple objects unless the context clearly dictates otherwise.

Also, as used in the description herein and throughout the claims that follow, the meaning of "in" includes "in" and "on" unless the context clearly dictates otherwise. It will be understood that when an element is referred to as being "on" another element, it can be directly on the other element or intervening elements may be present therebetween. In contrast, when an element is referred to as being "directly on" another element, there are no intervening elements present.

As used herein, the term "set" refers to a collection of one or more objects. Thus, for example, a set of objects can include a single object or multiple objects. Objects of a set also can be referred to as members of the set. Objects of a set can be the same or different. In some instances, objects of a set can share one or more common properties.

As used herein, the term "adjacent" refers to being near or adjoining. Adjacent objects can be spaced apart from one another or can be in actual or direct contact with one another. In some instances, adjacent objects can be coupled to one another or can be formed integrally with one another.

As used herein, the terms "connect," "connected," and "connecting" refer to a direct attachment or link. Connected objects have no or no substantial intermediary object or set of objects, as the context indicates.

As used herein, the terms "couple," "coupled," and "coupling" refer to an operational connection or linking. Coupled objects can be directly connected to one another or can be indirectly connected to one another, such as via an intermediary set of objects.

The use of the term "about" applies to all numeric values, whether or not explicitly indicated. This term generally refers to a range of numbers that one of ordinary skill in the art would consider as a reasonable amount of deviation to the recited numeric values (i.e., having the equivalent function or result). For example, this term can be construed as including a deviation of ±10 percent of the given numeric value provided such a deviation does not alter the end function or result of the value. Therefore, a value of about 1% can be construed to be a range from 0.9% to 1.1%.

As used herein, the terms "substantially" and "substantial" refer to a considerable degree or extent. When used in conjunction with an event or circumstance, the terms can refer to instances in which the event or circumstance occurs precisely as well as instances in which the event or circumstance occurs to a close approximation, such as accounting for typical tolerance levels or variability of the embodiments described herein.

As used herein, the terms "optional" and "optionally" mean that the subsequently described event or circumstance may or may not occur and that the description includes instances where the event or circumstance occurs and instances in which it does not.

As used herein, the term "size" refers to a characteristic dimension of an object. Thus, for example, a size of an object that is spherical can refer to a diameter of the object. In the case of an object that is non-spherical, a size of the non-spherical object can refer to a diameter of a corresponding spherical object, where the corresponding spherical object exhibits or has a particular set of derivable or measurable properties that are substantially the same as those of the non-spherical object. Thus, for example, a size of a non-spherical object can refer to a diameter of a corresponding spherical object that exhibits light scattering or other properties that are substantially the same as those of the non-spherical object. Alternatively, or in conjunction, a size of a non-spherical object can refer to an average of various orthogonal dimensions of the object. Thus, for example, a size of an object that is a spheroidal can refer to an average of a major axis and a minor axis of the object. When referring to a set of objects as having a particular size, it is contemplated that the objects can have a distribution of sizes around the particular size. Thus, as used herein, a size of a set of objects can refer to a typical size of a distribution of sizes, such as an average size, a median size, or a peak size.

The following description is provided for a specific type of stringed musical instrument having a neck—namely a guitar. While the present invention may be adapted for use with a guitar as exemplified in the representative FIGS. 1-7, the present invention is not limited to uses with a guitar. The guitar includes a body and narrower and slenderer neck extending away from the body for supporting a head. When processing the guitar, particularly elements of the neck or head, it is preferred to support the neck. This is because the body often rests on a support surface during processing and the orientation and construction of the neck typically leaves it unsupported above the support surface. The following description for a support cube identifies an improved support device for the neck during processing with the support cube disposed between the neck and the support surface.

Figure 2:
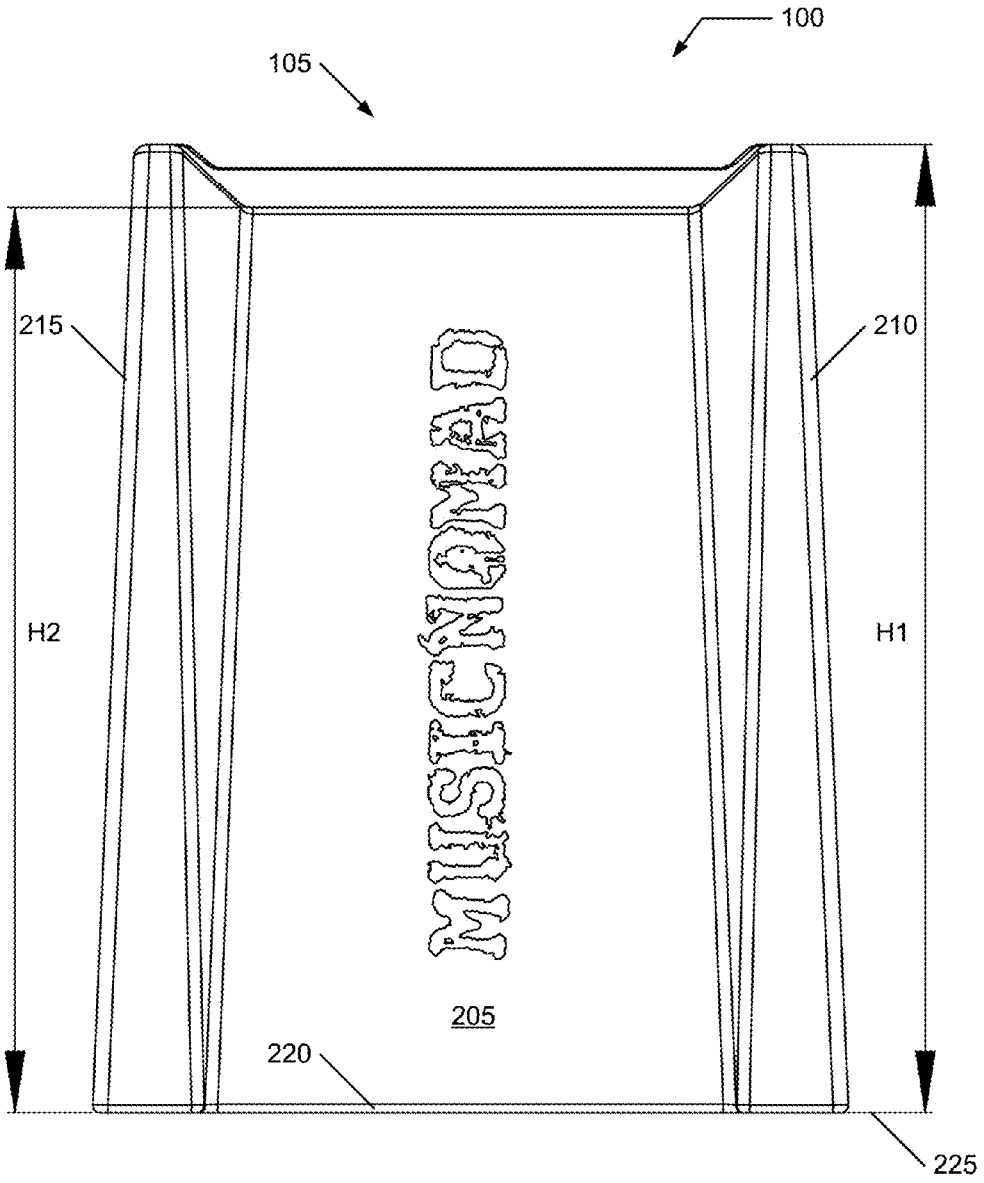
FIG. 2 illustrates a front view of the support cube illustrated in FIG. 1.
Figure 3:
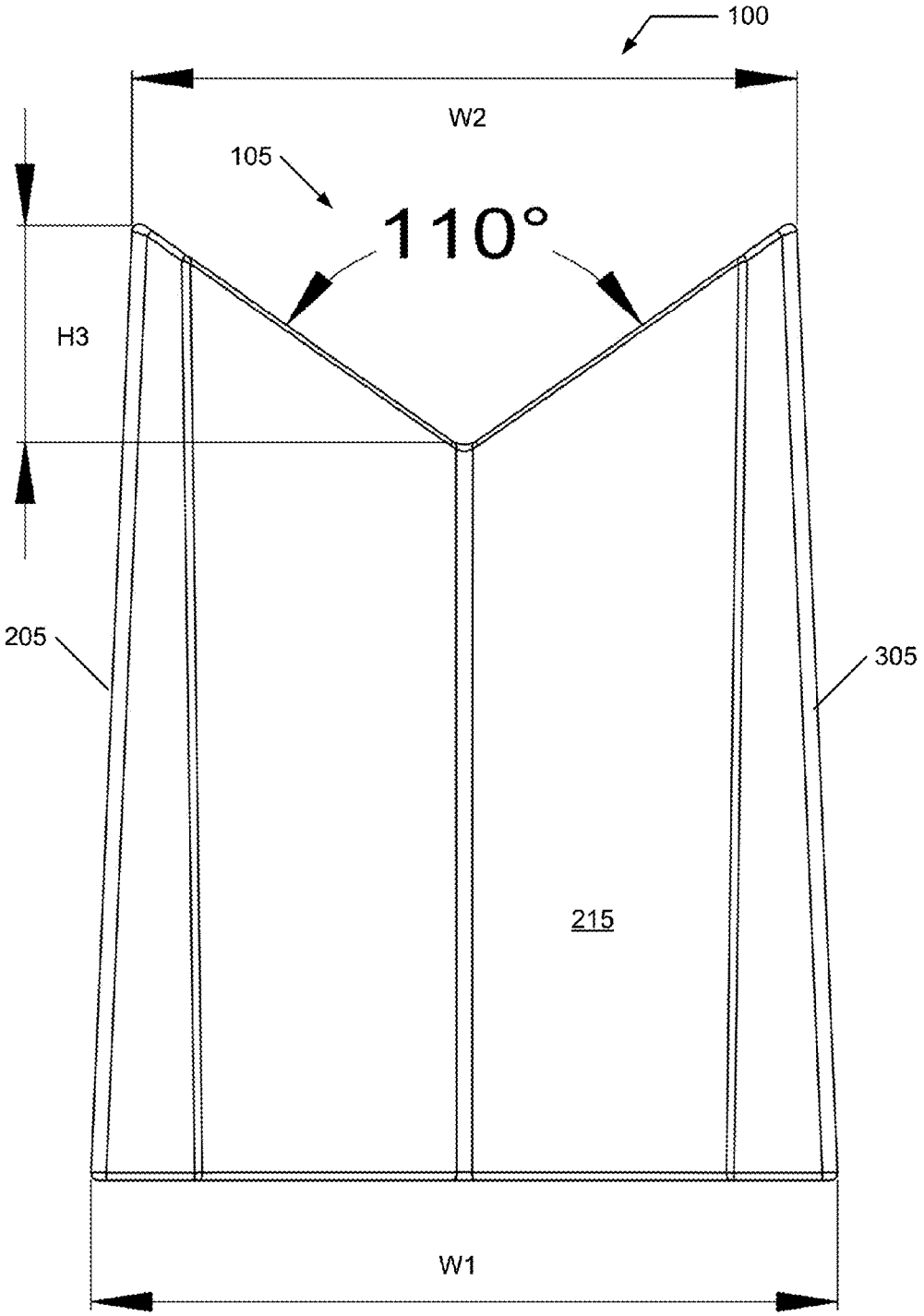
FIG. 3 illustrates a side view of the support cube illustrated in FIG. 1.
Figure 4:
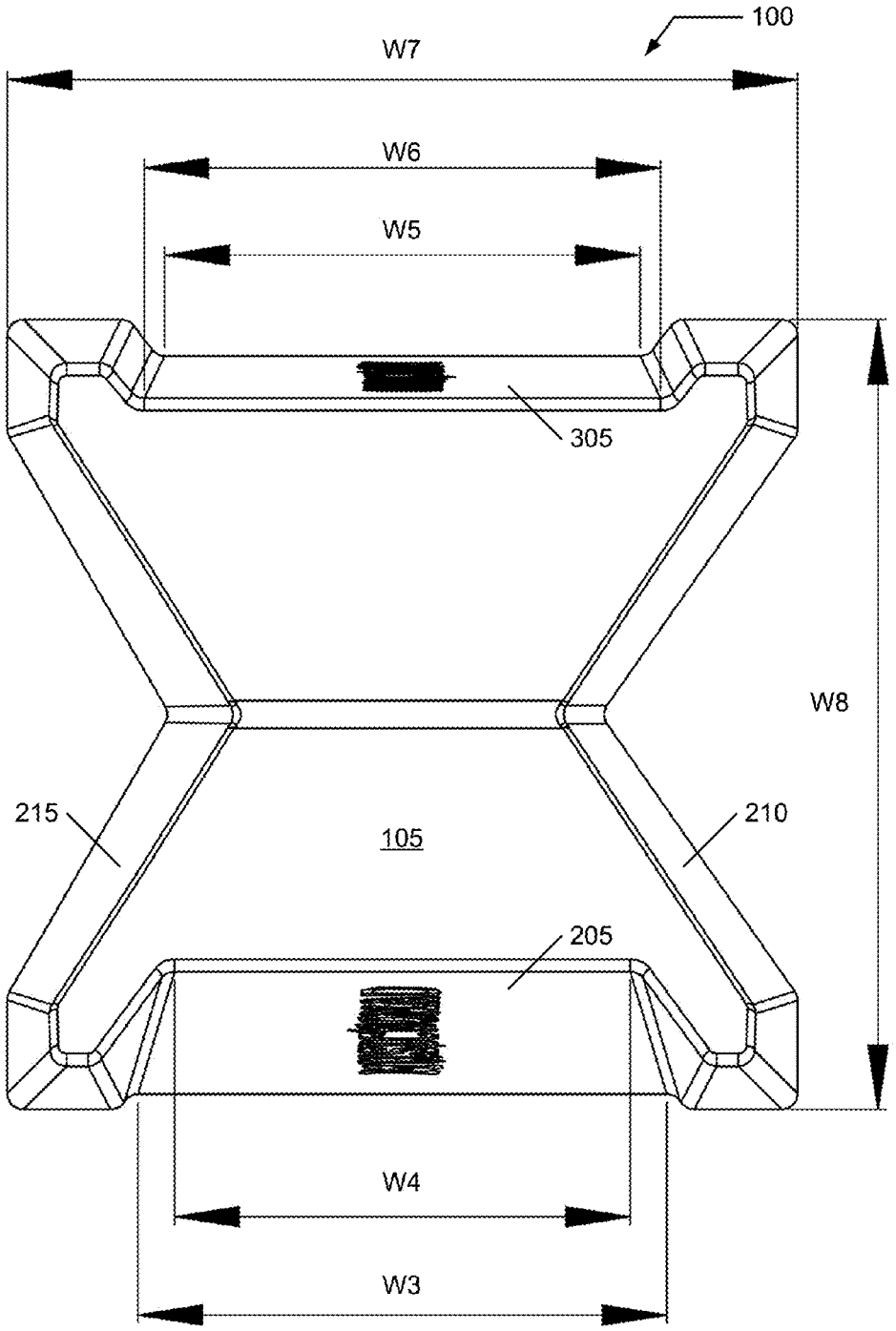
FIG. 4 illustrates a top view of the support cube illustrated in FIG. 1.
Figure 5:
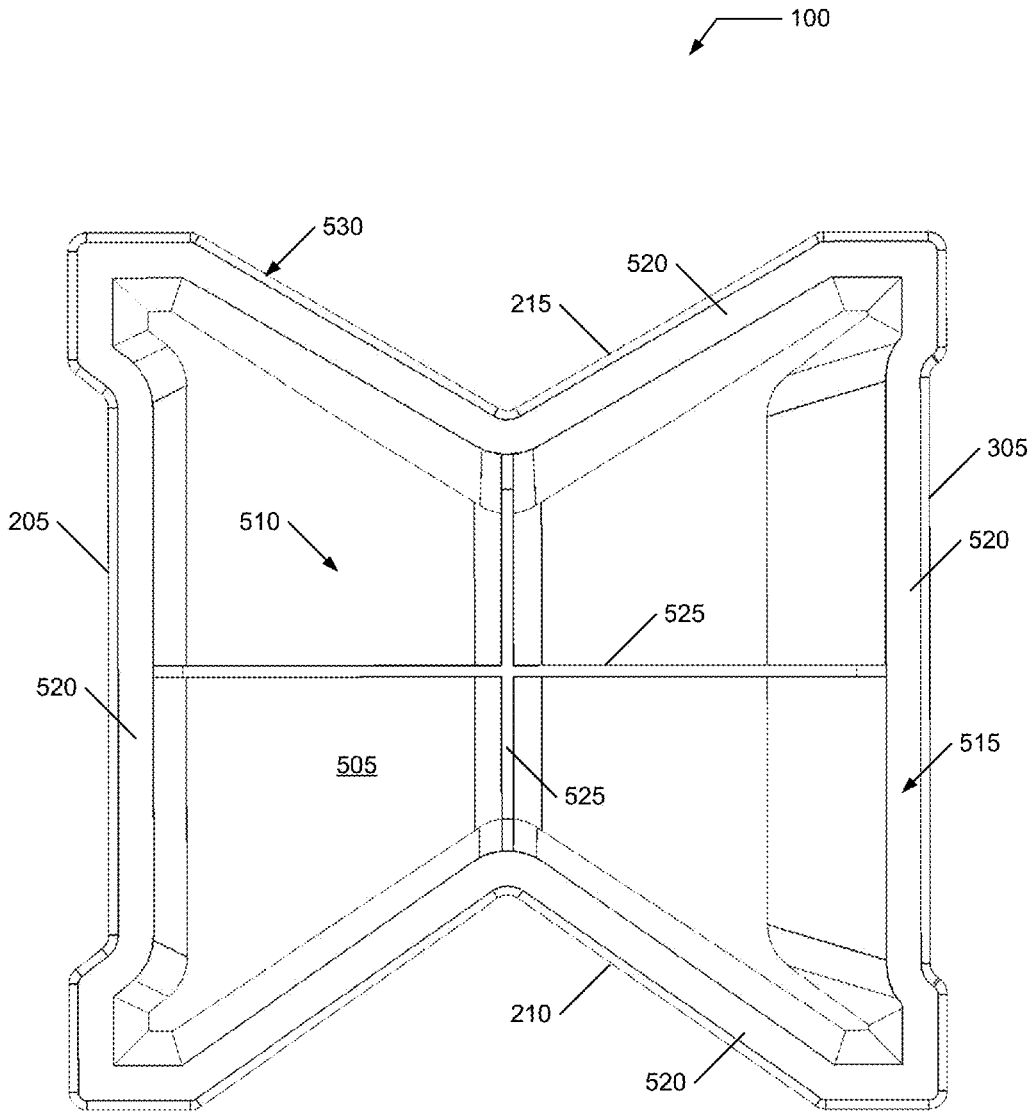
FIG. 5 illustrates a bottom view of the support cube illustrated in FIG. 1.

FIG. 1 illustrates a perspective view of a support cube 100; FIG. 2 illustrates a front view of support cube 100; FIG. 3 illustrates a side view of support cube 100; FIG. 4 illustrates a top view of support cube 100; and FIG. 5 illustrates a bottom view of support cube 100.

Support cube 100 includes a three-dimensional structure having a generally cuboid profile including five support faces and a caddy face 505: a top support face 105 and four lateral support faces including a front lateral support face 205, a right side lateral support face 210, a left side lateral support face 215, and a rear lateral support face 305. The lateral support faces include an outside surface having a soft pliable polymer network that provides cushioning and anti-marring support for contacting instruments including finishes such as nitrocellulose lacquer and other well-known materials.

The lateral support faces extend from a base 220 to top support face 105. Each support face of support cube 100 defines a support feature with each support feature having a central depression with a pair of straddling legs. These support features provide an instrument capture mechanism wherein the neck, during use, is disposed within the central depression between the pair of straddling legs. There are different types of support features that may be used with a support face including a "V-shaped depression" and a "slot depression" among other possible types of support features.

A V-shaped depression, such as included with top support face 105 and the lateral support faces (210 and 215) have a central valley with planar lateral walls. The central valley may be unsloped when considering one end of the central valley with respect to an opposing end of the central valley (such as the V-shaped depression included with top support face 105) or may be sloped (such as the V-shaped depressions included with the lateral support faces).

A slot depression, such as included in the front and rear support faces have a planar depression bottom with generally vertically extending lateral walls. The lateral side walls are preferred to be sloped and not perpendicular to the depression bottom though some embodiments may include vertical side walls. While a slot depression may, in general, include a depression bottom that is sloped or unsloped (one end of the slot relative to the other), in the illustrated embodiments the depression bottoms are sloped. The slot depressions may further include tapering (when moving from one end of the depression bottom to the other) lateral walls such that an end of the depression bottom closer to top support face 105 has a width (distance between lateral walls) that is narrower than a width of the depression bottom nearer base 220.

It is a feature of support cube 100 that each of the support faces present a different support option. Thus the support feature of top support face 105 includes an unsloped V-depression and the lateral support faces all present sloped support features, each having a different combination of support feature type and slope angle. In the illustrated embodiments, the angles are all less than 10 degrees and may all be different from one another. Further, beginning and/or ending slot widths of the depression bottoms of the slot depressions may be the same or different from other slot depressions. For the six-faced support cube 100, the five support faces each present a different support option as compared to any of the other support faces. Therefore support cube 100 is sometimes referred to as a 5-in-1 support cube.

For example, as seen in FIG. 4, the lateral support faces all have a different permutation of support feature options. And as compared to FIG. 2, each support feature of the lateral support features is different from a particular combination of support feature options of top support face 105.

The illustrated embodiments also include a preferred implementation of the straddling legs. Each straddling leg of a pair of straddling legs of a support feature include a flat top that is coplanar with its corresponding straddling leg. This allows any lateral support face to be disposed on a worksurface 225 that directly supports support cube 100 to present an opposing lateral support face above worksurface 225 with its support feature available for engaging the neck of the guitar.

While the specific dimensions of the various elements of support cube 100 may be varied to adapt it for a particular implementation and for a specific instrument or a specific class of instruments, the following Table I includes some representative heights (H) and widths (W) as identified in FIG. 2-FIG. 4.

TABLE I

Representative Dimensions of Support Cube 100

| Dimension | Value (mm) |
|---|---|
| H1 | 126.1 |
| H2 | 117.9 |
| H3 | 28.6 |
| W1 | 98.3 |
| W2 | 87.6 |
| W3 | 65.8 |
| W4 | 56.7 |
| W5 | 59.1 |
| W6 | 64.3 |
| W7 | 98.3 |
| W8 | 98.3 |

Caddy face 505 includes a planar opening into an internal cavity 510 defined by a frame structure 515. Frame structure 515 is formed from a rigid material and includes a set of exterior walls 520 corresponding to the support faces and a set of internal support elements 525. Internal support elements 525 are provided to add additional resistance to compressive loading of one or more of the support faces that could cause a support face to bow and/or buckle during processing of a musical instrument. Internal support elements 525 of the illustrated embodiment extend from one support face to an opposing support face and also extend from base 220 to top support face 105. Depending upon implementation details included expected support loads, and material composition and arrangement of frame structure 515, internal support elements 525 may be optional or may be optional as to thickness, arrangement, and internal length. For example, decreasing a length (extent of elements between base 220 and top support face 105) may save some material costs and ultimately the overall cost of the product to the user.

An exterior pliable shell or sleeve 530 is disposed over frame structure 515 with shell 530 providing the protective conforming surfaces for the support faces. Caddy face 505 permits support cube 100 to have top support face 105 disposed directly on worksurface 225 which presents opposing caddy face 505 on top. The opening allows a user to store instruments, tools, and/or supplies used in processing within internal cavity 510, such as when no support face is actively supporting a musical instrument.

In operation of actively supporting a musical instrument using a support face, support cube 100 operates in cooperation with worksurface 225. A user determines a desired support face to be used to directly support an element of the musical instrument and rotates support cube 100 in three-dimensional space until the desired support face is on top. The user lowers support cube 100 onto worksurface 225 until a face opposite of the desired support face contacts worksurface 225. Either base 220 or a pair of straddling legs of the opposing face solidly maintain support cube 100 with the desired support face on top. This allows the user to process the musical instrument simply and efficiently. Should another support feature be desired, support cube 100 is rotated until the support face having the support feature is on top and the opposing face is lowered onto worksurface 225. This continues until processing is complete.

Figure 6:
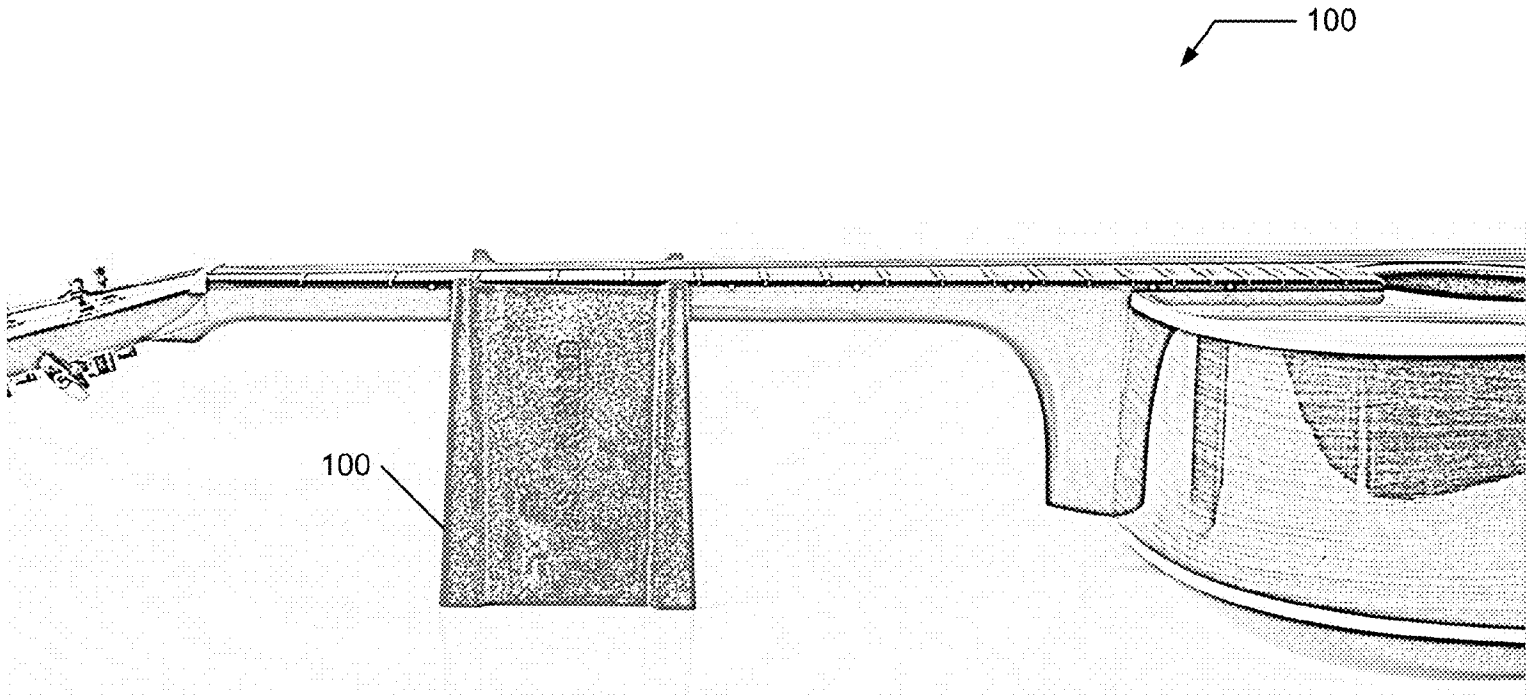
FIG. 6 illustrates a first representative use of the support cube illustrated in FIG. 1.
Figure 7:
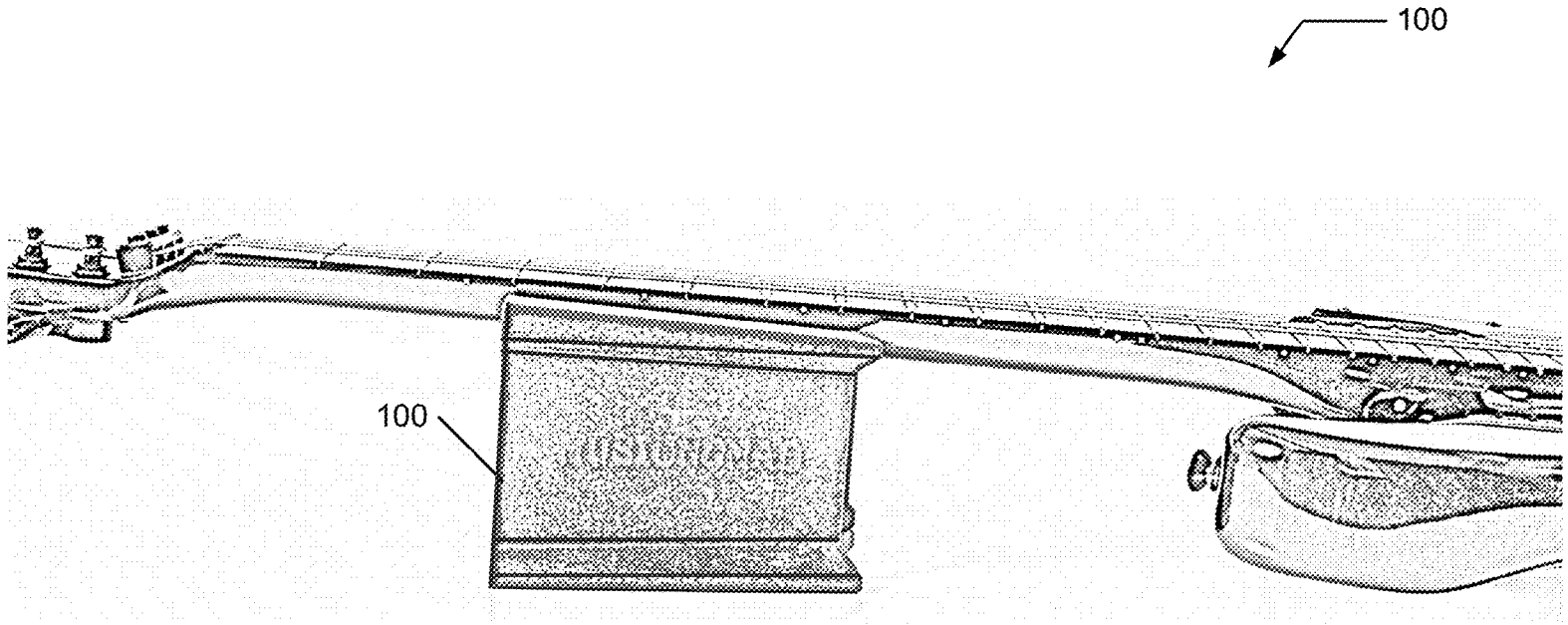
FIG. 7 illustrates a second representative use of the support cube illustrated in FIG. 1.

FIG. 6 illustrates a first representative use of support cube 100 to employ top support face 105 to hold a neck of a first guitar relatively parallel to the worksurface 225; and FIG. 7 illustrates a second representative use of support cube 100 to employ a lateral support face to hold a neck of a second guitar at a desired angle with respect to the worksurface 225. One use of cube 100 in the configuration of FIG. 7 is that the upper strings may be separated and passed over side/lateral surfaces to maintain the strings away from the neck. The lateral edges include longitudinal supports that help to retain the strings in this arrangement.

FIG. 8-FIG. 11 illustrate representative slope values for depressions disposed within intermediate surfaces of a support cube 800. Cube 800, based generally on cube, is presented to simplify the following discussion of various slope values of depressions in intermediate surfaces cube 100. Any discrepancy between illustrations of cube 100 and cube 800 should be either resolved by reference to the specifics of cube 800 or considered to be within a range of embodiments of the present invention, as the context indicates.

Figure 8:
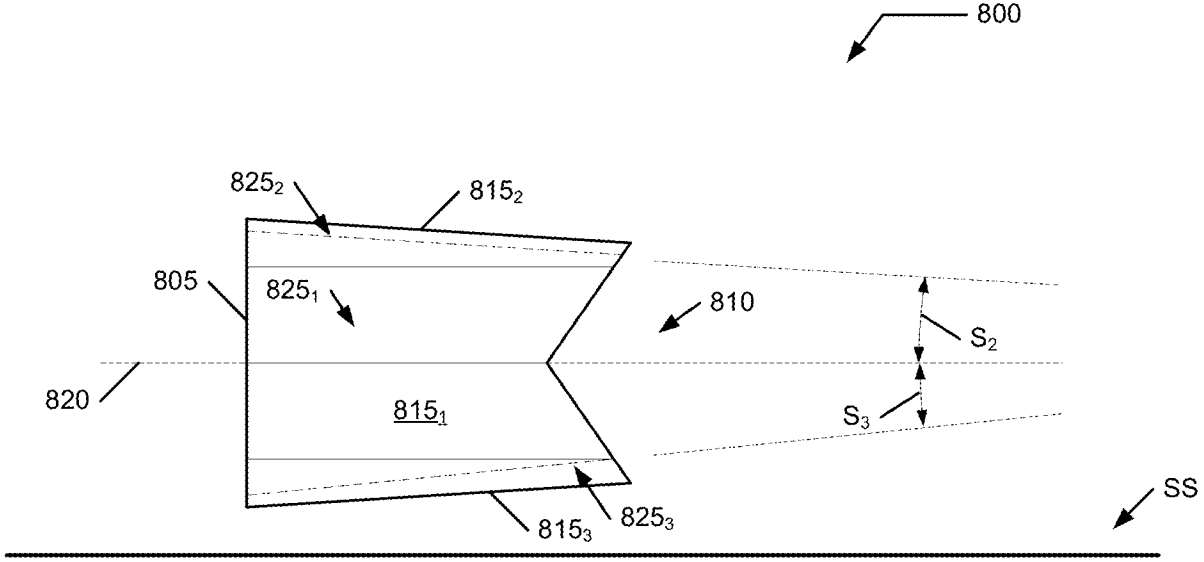
FIG. 8-FIG. 11 illustrate representative slope values for depressions disposed within intermediate surfaces of a support cube.

FIG. 8 illustrates a representative support cube 800 above a planar support surface SS, Cube 800 includes a first surface 805, a second surface 810 spaced apart from first surface 805, and a plurality of intermediate surfaces $\mathbf{815}_i$, i=1 to N where N is a number of "sides" equal to 4, 5, 6, 7, 8, 9, 10, or more (as illustrated in FIG. 8, N=4). Cube 800 further includes a longitudinal axis 820 extending from first surface 805 to second surface 810. Each intermediate surface $\mathbf{815}_i$ includes a corresponding depression $\mathbf{825}_i$ that extends longitudinally from first surface 805 to second surface 810. Each depression $\mathbf{825}_i$ has an associated slope S, measured relative to longitudinal axis 820.

Figure 9:
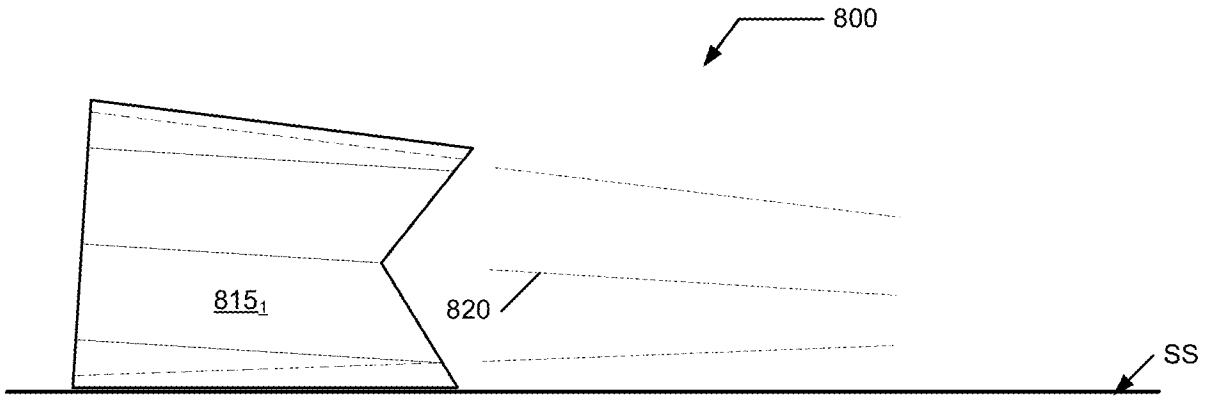

FIG. 9 illustrates the representative support cube of FIG. 8 tilting longitudinal axis 820 so a bottom intermediate surface $\mathbf{815}_i$ (in FIG. 8, surface $\mathbf{815}_3$) aligns with, and rests on, support surface SS.

Figure 10:
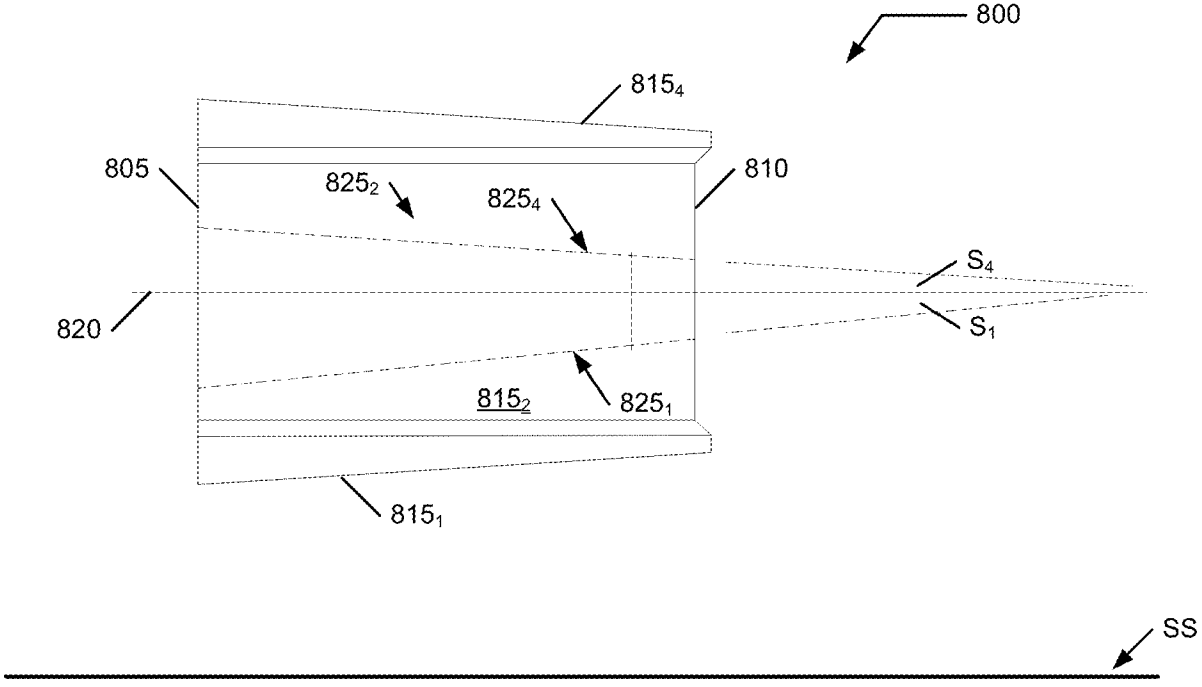

FIG. 10 illustrates support cube above 800 (different scale than FIG. 8-9) disposed above planar support surface SS in a different orientation that illustrated in FIG. 8 and further depicting a second set of slope values S1 and S4 of another pair of depressions (respectively of first depression $\mathbf{825}_1$ and second depression $\mathbf{825}_4$) in a second set of opposing intermediate surfaces $\mathbf{815}_1$ and $\mathbf{815}_4$, respectively. Specifically, cube 800 is rotated ninety degrees about longitudinal axis 820 to position first intermediate surface $\mathbf{815}_1$ as a bottom surface (which also rotates fourth intermediate surface $\mathbf{815}_4$ as a top surface). As illustrated, each intermediate surface $\mathbf{815}_i$, includes an opposite intermediate surface $\mathbf{815}_k$.

Figure 11:
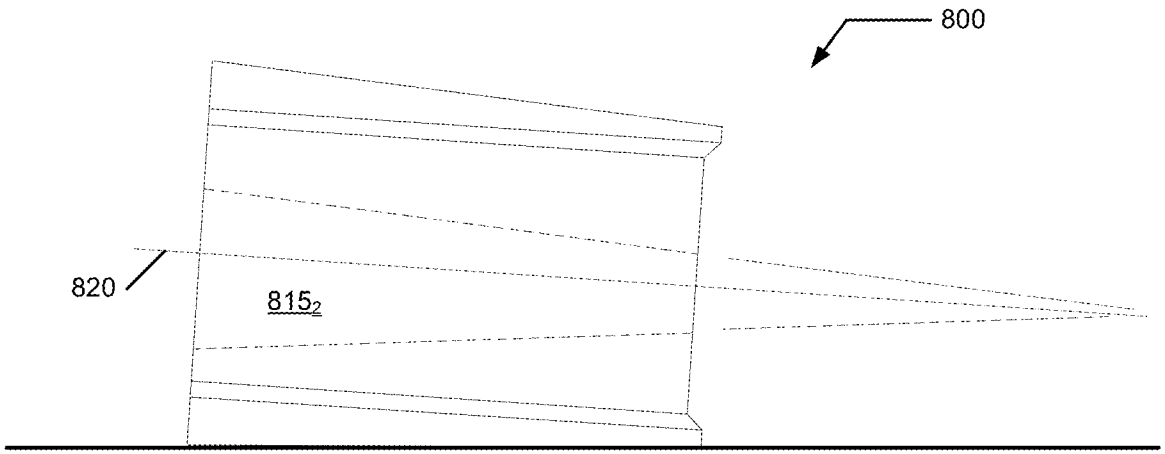

FIG. 11 illustrates the representative support cube illustrated in FIG. 10 tilting longitudinal axis 820 so a bottom intermediate surface 815$_i$ (in FIG. 10, surface 815$_1$) aligns with, and rests on, support surface SS.

Intermediate surfaces 815$_i$ as illustrated when i=4 may have a correspondence with lateral support surfaces of cube 100, for example: 815$_1$ may correspond to surface 205, 815$_2$ may correspond to surface 215, 815$_3$ may correspond to surface 210, and 815$_4$ may correspond to surface 305.

Some embodiments present multiple different depression contours, or profiles (for example U-shaped cross-sections and V-shaped cross-sections among the different depressions. And for some embodiments, the multiple depressions present different slopes. In some embodiments, there are multiple depression profiles and each depression presenting a different slope as compared to any other slope of any other depression in an intermediate surface. (Each depression 825$_i$ is provided with a lateral support system, for example lateral longitudinal side rails extending from surface 805 to surface 810, to contact support surface SS and thereby rigidly support cube 800 with any intermediate surface 815$_i$ and its associated depression 825$_i$ on "top"). Other configurations for the support system are possible, such as structure at each of four corners of each intermediate surface 815.

When using the dimensions associated with cube 100 described herein, a width of first surface 805 is about equal to a length of 805 (generally a square shape) and a width and length of second surface 810 is also about equal to generally define a square shape. However, the square of first surface 805 is larger than the square of second surface 810 which imparts about a 2.5 degree downward tilt of longitudinal axis 820 when a particular intermediate surface 815$_i$ rests on a horizontal support surface SS as illustrated in FIG. 9. This tilt is in addition to the slopes identified in FIG. 8-11.

As illustrated and described herein, one particular embodiment out of many different possible embodiments includes four intermediate surfaces 815, each having a longitudinal depression including a channel and lateral supports straddling the channel. These supports provide a rigid support for cube 800 when intermediate surface is disposed next to a support surface to maintain a solid work surface using the depression of the topmost exposed intermediate surface. Each depression is different from all other depressions, such as a cross-section profile and slope combination. As illustrated, all slopes relative to the longitudinal axis are different from each other and none of which exceed a desired angle, such as not more than 10 degrees, or not more than 7.5 degrees, or not more than 5 degrees.

While the illustrated embodiment includes a tool caddy feature to store tools and implements between uses of support cube 100, some implementations may further include a number of integrated tools and/or implements. For example, a support cube 100 may be adapted for a primary emphasis on support during re-stringing operations. A tool that is useful in such processing of a musical instrument includes a string tuner. Some implementations of support cube 100 will include an optional integrated tool feature, such as an integrated string tuner.

The system and methods above has been described in general terms as an aid to understanding details of preferred embodiments of the present invention. In the description herein, numerous specific details are provided, such as examples of components and/or methods, to provide a thorough understanding of embodiments of the present invention. It is not required that implementations of the present invention include a cubic implementation having four lateral support faces as some implementations may include N number of lateral support faces, N>4 for example, N=5, 6, 7, 8, 9, 10, or more (though preferably N is even). Other embodiments may include a single piece construction and some embodiments, may not include the optional internal cavity (e.g., they may be solid). Some embodiments may have the cushioning exterior layer integrated with the support frame, or have the entire device made from the device made from a single material. Some embodiments may not include a cushioning anti-damage interface and be implemented as a single plastic material, allowing and/or requiring a user to provide their own cushioning interface, and some may dispose the protective and/or cushioning material on less than all supporting faces. Support features may be provided in less than all possible support faces. Some features and benefits of the present invention are realized in such modes and are not required in every case. One skilled in the relevant art will recognize, however, that an embodiment of the invention can be practiced without one or more of the specific details, or with other apparatus, systems, assemblies, methods, components, materials, parts, and/or the like. In other instances, well-known structures, materials, or operations are not specifically shown or described in detail to avoid obscuring aspects of embodiments of the present invention.

Reference throughout this specification to "one embodiment", "an embodiment", or "a specific embodiment" means that a particular feature, structure, or characteristic described in connection with the embodiment is included in at least one embodiment of the present invention and not necessarily in all embodiments. Thus, respective appearances of the phrases "in one embodiment", "in an embodiment", or "in a specific embodiment" in various places throughout this specification are not necessarily referring to the same embodiment. Furthermore, the particular features, structures, or characteristics of any specific embodiment of the present invention may be combined in any suitable manner with one or more other embodiments. It is to be understood that other variations and modifications of the embodiments of the present invention described and illustrated herein are possible in light of the teachings herein and are to be considered as part of the spirit and scope of the present invention.

It will also be appreciated that one or more of the elements depicted in the drawings/figures can also be implemented in a more separated or integrated manner, or even removed or rendered as inoperable in certain cases, as is useful in accordance with a particular application.

Additionally, any signal arrows in the drawings/Figures should be considered only as exemplary, and not limiting, unless otherwise specifically noted. Combinations of components or steps will also be considered as being noted, where terminology is foreseen as rendering the ability to separate or combine is unclear.

The foregoing description of illustrated embodiments of the present invention, including what is described in the Abstract, is not intended to be exhaustive or to limit the invention to the precise forms disclosed herein. While specific embodiments of, and examples for, the invention are described herein for illustrative purposes only, various equivalent modifications are possible within the spirit and scope of the present invention, as those skilled in the relevant art will recognize and appreciate. As indicated, these modifications may be made to the present invention in light of the foregoing description of illustrated embodiments of the present invention and are to be included within the spirit and scope of the present invention.

Thus, while the present invention has been described herein with reference to particular embodiments thereof, a latitude of modification, various changes and substitutions are intended in the foregoing disclosures, and it will be appreciated that in some instances some features of embodiments of the invention will be employed without a corresponding use of other features without departing from the scope and spirit of the invention as set forth. Therefore, many modifications may be made to adapt a particular situation or material to the essential scope and spirit of the present invention. It is intended that the invention not be limited to the particular terms used in following claims and/or to the particular embodiment disclosed as the best mode contemplated for carrying out this invention, but that the invention will include any and all embodiments and equivalents falling within the scope of the appended claims. Thus, the scope of the invention is to be determined solely by the appended claims.

What is claimed as new and desired to be protected by Letters Patent of the United States is:

1. A support structure, comprising:

a housing defining a first surface, a second surface spaced apart from said first surface, and a longitudinal axis and a plurality of intermediate surfaces extending from said first surface to said second surface;

wherein a first particular one of said intermediate surfaces includes a first depression extending longitudinally from said first surface to said second surface, said first depression having a first slope, relative to said longitudinal axis, extending from said first surface to said second surface;

wherein a second particular one of said intermediate surfaces includes a second depression extending longitudinally from said first surface to said second surface, said second depression having a second slope, relative to said longitudinal axis, extending from said first surface to said second surface; and wherein said first slope is different from said second slope.

2. The support structure of claim 1 wherein each said intermediate surface includes a depression extending longitudinally from said first surface to said second surface with said depression having a slope, relative to said longitudinal axis, extending from said first surface to said second surface, and wherein each said slope is different from each other slope.

3. The support structure of claim 1 wherein each said slope is no greater than 10 degrees.

4. The support structure of claim 1 wherein each said slope is no greater than 5 degrees.

5. The support structure of claim 2 wherein each said slope is no greater than 10 degrees.

6. The support structure of claim 2 wherein each said slope is no greater than 5 degrees.

7. The support structure of claim 1 wherein said first surface has a first width and a first length about equal to said first width and wherein said second surface has a second width and a second length about equal to said second width.

8. The support structure of claim 7 wherein said second width is less than said first width, wherein said second surface is spaced apart from said first surface by a height, and wherein a width difference equals said first width minus said second width and wherein an inverse tangent function of one-half said width difference divided by said height is about 2.5 degrees.

9. The support structure of claim 8 wherein said first width is about 98.3 millimeters, said second width is about 87.6 millimeters, and said height is about 126.1 millimeters.

10. The support structure of claim 8 wherein each said slope is no greater than 10 degrees.

11. The support structure of claim 8 wherein each said slope is no greater than 5 degrees.

12. The support structure of claim 9 wherein each said slope is no greater than 10 degrees.

13. The support structure of claim 9 wherein each said slope is no greater than 5 degrees.

14. The support structure of claim 1 wherein each said depression includes a channel extending longitudinally from said first surface to said second surface with said channel including a central portion and having a channel distance spaced from said longitudinal axis and wherein each said channel includes a pair of lateral support structures disposed on opposite edges of said central portion with each lateral support structure having a support distance spaced from said longitudinal axis greater than said channel distance.

15. The support structure of claim 2 wherein each said depression includes a channel extending longitudinally from said first surface to said second surface with said channel including a central portion and having a channel distance spaced from said longitudinal axis and wherein each said channel includes a pair of lateral support structures disposed on opposite edges of said central portion with each lateral support structure having a support distance spaced from said longitudinal axis greater than said channel distance.

16. The support structure of claim 7 wherein each said depression includes a channel extending longitudinally from said first surface to said second surface with said channel including a central portion and having a channel distance spaced from said longitudinal axis and wherein each said channel includes a pair of lateral support structures disposed on opposite edges of said central portion with each lateral support structure having a support distance spaced from said longitudinal axis greater than said channel distance.

17. The support structure of claim 13 wherein each said depression includes a channel extending longitudinally from said first surface to said second surface with said channel including a central portion and having a channel distance spaced from said longitudinal axis and wherein each said channel includes a pair of lateral support structures disposed on opposite edges of said central portion with each lateral support structure having a support distance spaced from said longitudinal axis greater than said channel distance.

18. The support structure of claim 14 wherein each said depression includes a uniform cross-section in a plane perpendicular to said longitudinal axis.

19. The support structure of claim 18 wherein said uniform cross-section includes a "U" shaped profile.

20. The support structure of claim 18 wherein said uniform cross-section includes a "V" shaped profile.

21. The support structure of claim 1 wherein said first depression includes a first channel extending longitudinally from said first surface to said second surface with said first channel including a first central portion and having a first channel distance spaced from said longitudinal axis and wherein said first channel includes a first pair of lateral support structures disposed on opposite edges of said first central portion with each said lateral support structure of said first pair of lateral support structures having a first support distance spaced from said longitudinal axis greater than said first channel distance, and wherein said second depression includes a second channel extending longitudinally from said first surface to said second surface with said second channel including a second central portion and having a second channel distance spaced from said longitudinal axis and wherein said second channel includes a second pair of lateral support structures disposed on opposite edges of said second central portion with each said lateral support structure of said second pair of lateral support structures having a second support distance spaced from said longitudinal axis greater than said second channel distance.

22. The support structure of claim 21 wherein said first channel includes a first uniform cross-section in a plane perpendicular to said longitudinal axis, wherein said second channel includes a uniform cross-section in said plane perpendicular to said longitudinal axis, and wherein said first uniform cross-section is different from said second uniform cross-section.

23. The support structure of claim 22 wherein said first uniform cross-section includes a "U" shaped profile and wherein said second uniform cross-section includes a "V" shaped profile.

24. The support structure of claim 1 wherein said first surface lies in a first plane generally perpendicular to said longitudinal axis, wherein said second surface includes a lateral depression extending from a first one of said intermediate surfaces to a second one of said intermediate surfaces, said lateral depression extending perpendicular to said longitudinal axis, and wherein a central portion of said lateral depression is substantially parallel to said first plane.

25. A support structure, comprising:

a housing defining a first surface, a second surface spaced apart from said second surface, a longitudinal axis extending from said first surface to a second surface, a first intermediate surface extending longitudinally from said first surface to said second surface, a second intermediate surface extending longitudinally from said first surface to said second surface and disposed opposite of said first intermediate surface, a third intermediate surface extending longitudinally from said first surface to said second surface, and a fourth intermediate surface extending longitudinally from said first surface to said second surface and disposed opposite of said third intermediate surface, wherein each said intermediate surface includes a uniform cross-section depression extending longitudinally from said first surface to said second surface;

wherein each said depression includes a slope, relative to said longitudinal axis, extending from said first surface to said second surface;

wherein a first pair of intermediate surfaces include said first intermediate surface and said second uniform surface;

wherein a second pair of intermediate surfaces include said third intermediate surface and said fourth uniform surface;

wherein said depressions of said first pair of intermediate surfaces include a "U" shaped profile;

wherein said depressions of said second pair of intermediate surfaces include a "V" shaped profile;

wherein said first surface has a first width and a first length about equal to said first width and wherein said second surface has a second width and a second length about equal to said second width;

wherein said second width is less than said first width, wherein said second surface is spaced apart from said first surface by a height, and wherein a width difference equals said first width minus said second width and wherein an inverse tangent function of one-half said width difference divided by said height is about 2.5 degrees; and wherein said slopes are different from each other and no greater than about 5 degrees.

26. The support structure of claim 25 wherein said first surface lies in a first plane generally perpendicular to said longitudinal axis, wherein said second surface includes a lateral depression extending from a first one of said intermediate surfaces to a second one of said intermediate surfaces, said lateral depression extending perpendicular to said longitudinal axis, and wherein a central portion of said lateral depression is substantially parallel to said first plane.

* * * * *